United States Patent [19]

Jones

[11] 4,433,929

[45] Feb. 28, 1984

[54] RECYCLABLE PAPER BINDING MEANS

[76] Inventor: Peter D. Jones, Canabury Square Apts. No. 365; Demont Ave., St. Paul, Minn. 55117

[21] Appl. No.: 279,786

[22] Filed: Jul. 2, 1981

[51] Int. Cl.[3] ..... B42F 3/00

[52] U.S. Cl. ..... 402/14; 24/150 R; 29/451; 402/19; 402/80 R

[58] Field of Search ..... 402/4, 11, 15, 17, 18, 402/19, 61, 80 R, 14; 29/451; 24/150 R, 150 B, 150 DB, 150 FP; 227/DIG. 1

[56] References Cited

U.S. PATENT DOCUMENTS

| | | | |
|---|---|---|---|
| 451,710 | 5/1891 | Grunzweig | 227/DIG. 1 |
| 805,002 | 11/1905 | Chain | 402/14 |
| 1,479,740 | 1/1924 | Reiter | 402/61 |
| 1,531,625 | 3/1925 | Rogers | 402/14 |
| 3,209,422 | 10/1965 | Dritz | 29/451 X |
| 3,217,372 | 11/1965 | Fellowes | 402/17 |
| 3,263,689 | 8/1966 | Lindgren et al. | 402/17 |
| 3,362,411 | 1/1968 | Moller | 402/15 |
| 3,362,412 | 1/1968 | Moller | 402/15 |
| 3,866,274 | 2/1975 | Malavazos | 402/11 X |
| 4,057,886 | 11/1977 | Brass | 29/451 X |
| 4,184,782 | 1/1980 | Giulie | 402/15 |

*Primary Examiner*—Paul A. Bell

*Attorney, Agent, or Firm*—Jacobson & Johnson

[57] ABSTRACT

A fastener member to hold sheets of paper in a stack and ultimately be recycled at the same time the paper stacks are recycled. The fastener comprises a rolled material which is tightly bound to itself to produce a rigid shank for use as a fastening member.

8 Claims, 7 Drawing Figures

RECYCLABLE PAPER BINDING MEANS

FIELD OF THE INVENTION

This invention relates generally to means for fastening stacks of paper together and, more specifically, to a means and method for fastening paper together that permits recycling of the paper without requiring removal of the fastening members.

BACKGROUND OF THE INVENTION

Computer print outs are often made on a paper that is perforated along the edge so that a drive mechanism can pull the paper at a controlled rate through a printer. Generally, the paper is stored in continuous length comprising a stack of sheets with an accordian fold between each adjacent sheet. The drive mechanism can pull the paper through the printer as each sheet unfolds from the stack of sheets. After printing the printed sheets are restacked with the sheets refolded along the same accordian fold to form a stack of printed sheets. In some instances the outside edge of the stack can be coded so that the paper belonging to a given report can be easily distinguished and separated from preceding and subsequent material.

The individual pages in the stack can either be separated (burst) or used without further processing. In either case the individual sheets of the report can become mixed or lost if they are not held in proper position in the stack.

To prevent the individual sheets from separating the prior art uses a binding system wherein metal posts are inserted through the openings in each sheet and a metal bar is secured to the posts on each side of the stack to bind the stack of papers together.

Many of the reports contain information of a transitory value and are useful for only a short period of time. Therefore, it is customary to remove the metal posts and recycle the paper. Removing the metal posts is a time-consuming and expensive task that is a detriment to the economics of a recycling process.

My invention provides a means and method to bind the print out sheets and the like with low cost binding members that need not be removed when the print out sheets are recycled.

DESCRIPTION OF THE PRIOR ART

The concept of paper fasteners or paper binders is well known in the art. Many different types of fasteners have been used as illustrated by the following U.S. patents:

Swartwout U.S. Pat. No. 23,322 shows a paper fastener made from a flat strip. The flat strip has two triangular projections which can be forced through the paper and clinched to fasten a set of papers together.

Thayer U.S. Pat. No. 217,831 shows a metal fastener having a shank and a head and a second separator washer head which can be attached to the shank. The shank is inserted through an opening in the paper and the second head is fastened to the shank.

Thorp U.S. Pat. No. 219,419 shows a metallic edge binder for placing over the edge of a plurality of sheets to produce a book.

Wheeler U.S. Pat. No. 445,436 shows a rivet which is driven through a stack of papers. A washer which fastens to rivet holds the papers together.

Denis U.S. Pat. No. 643,045 shows a fastener having a shank with a series of grooves therein to engage a washer. The shank is inserted through a stack of papers and the washer is inserted on the shank to hold the papers together.

Reiter U.S. Pat. No. 1,479,740 shows a connector for loose leaf binders which has a cap on both ends and a collar that attaches to the material.

Fellowes U.S. Pat. No. 3,217,372 shows a pair of binder poles which are made from a rubber-like material such as polyethlene so as to be both flexible and spring-like. The posts are bent over and clipped to hold the papers in place.

Lindgren, et al. U.S. Pat. No. 3,263,689 shows a similar pair of post binders which can be bent over to hold a stack of papers in place.

Moller U.S. Pat. No. 3,362,412 shows a polymer plastic member that can be inserted through the opening in a stack of papers and fastened to themselves to hold a stack of papers in place.

Corey U.S. Pat. No. 3,741,385 shows a flat fastening device which can be inserted through an opening and bent over to hold the paper sheets of material.

Malavazos U.S. Pat. No. 3,866,274 shows a pair of binding posts for interlocking with each other to hold a stack of papers in place. Each of the binding posts have ratchet teeth for engaging each other.

Heimberger U.S. Pat. No. 3,962,007 shows fasteners having humps thereon which are fastened to a tape.

Giulie U.S. Pat. No. 4,184,782 shows a set of locking channels and flexible radially deformable filaments which are used for holding a stack of sheets in place.

Tsao-Tsung U.S. Pat. No. 4,244,085 shows a wire fastener that functions as a pin and clip.

BRIEF DESCRIPTION OF THE INVENTION

The present invention comprises a recyclable fastening member that provides an inexpensive method of securing a stack of papers together to form a single bound stack of papers. The fastening member permits the bound stack of papers and the fastening member to be simultaneously recycled. The preferred fastening member is made of biodegradable material such as rolled paper. In an alternate embodiment small amounts of biodegradable adhesive coatings can be used for fastening retaining collars or heads on the fastening members.

DESCRIPTION OF THE PREFERRED EMBODIMENT

Figure 1:
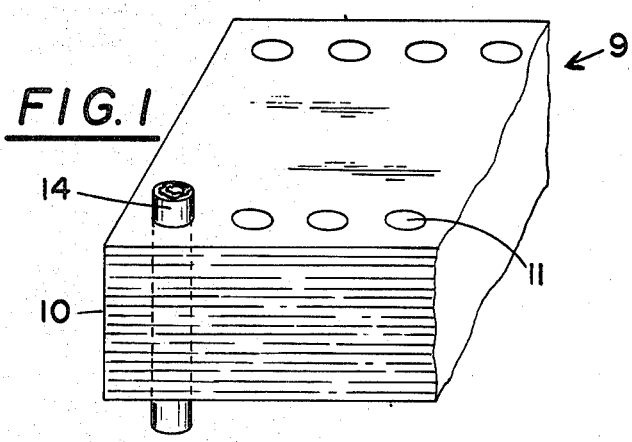
FIG. 1 shows a stack of computer print out paper with my fastening member located thereon.

Referring to the drawings, FIG. 1 shows a stack 9 of conventional computer print out sheets 10 with each of the ends of paper sheets 10 linked to the preceding and subsequent paper sheet in stack 9. A set of aligned perforation holes 11 extend through the stack of paper sheets.

My cylindrical fastening member 14 is shown extending through one of holes 11 in stack 9.

Figure 2:
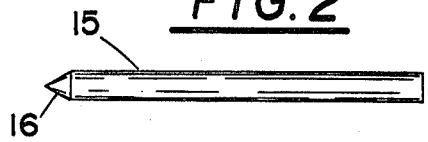
FIG. 2 is one embodiment of my fastening member.
Figure 5:
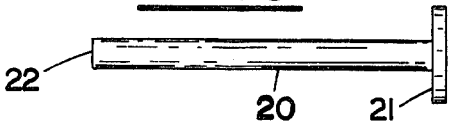
FIG. 5 shows a fastening member with an integral head.
Figure 3:
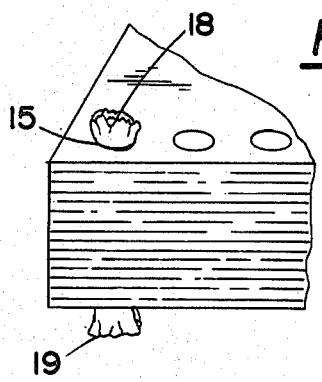
FIG. 3 shows a fastening member with splayed ends.

FIG. 2 shows a fastening member shank 15 having a pointed end 16 for ease of insertion into the holes in a stack of paper sheets. Typically, fastening member is comprised of a cylindrical shank 15 that is made of recyclable material such as paper or other fiberous biodegradable materials. In the embodiment shown in FIG. 2 shank 15 has a sharp point 16 on one end with a smooth shank 15. In operation shank 15 is inserted through the openings in the stack of sheets 9. As shown in FIG. 1, shank 15 is allowed to protrude beyond the ends of stack 9. Next, the shank 15 is cut to proper length with a side cutter or the like. Typically, this requires leaving $\frac{1}{4}$ of an inch to $\frac{1}{2}$ of an inch extending beyond the stack. To attach the fastening member to the stack each end of shank 15 is flared or splayed to produce retaining heads on opposite ends of the shank. FIG. 3 shows the ends of fastening member having a first splayed end 18 and a second splayed end 19. A simple flaring tool such as a phillips screw driver or a conical center punch may be used to flare the ends of shank 15. In the preferred embodiment shanks 15 are made of rolled paper such as used in lollipop sticks.

Figure 4:
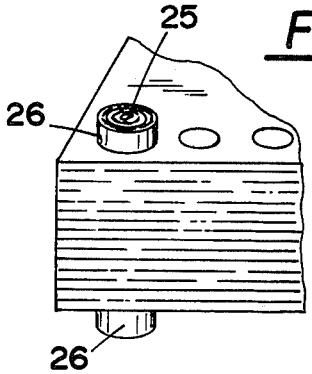
FIG. 4 shows a fastening member with retaining collars.

FIG. 4 shows a fastening member shank 25 having a paper washer 26 attached to one end of fastening member 25 and a paper washer 26 attached to the opposite end of fastening member shank 25. Paper washer 26 may be fastened to fastening member shank 25 by an adhesive, a friction fit or by flaring the end of the fastening member shank 25. For rigidity, paper washer 26 is formed and rolled into a cylindrical shape.

The simplest and least expensive form of the invention is illustrated in FIG. 2. It is well known in the art that a paper cylinder with sufficient rigidity can be manufactured by rolling multiple sheets of paper into a tight roll either with or without a biodegradable adhesive material. An example of such a product is the paper handle used in candy suckers or lollipop sticks. I have found that these conventional lollipop sucker sticks with a diameter of about 5/32 of an inch have sufficient length and diameter to secure a stack of papers over four inches thick. If the stack is shorter, the end of the sucker sticks can easily be cut to length by a side cutter or the like. I have also found that if the sucker sticks are subject to immersion in water for a period of time, they unroll and return to ordinary paper stock. This permits the paper in the sucker sticks to be recycled at the same time as the stacks of print out paper. The ends of the sucker sticks can also be deformed with a pointed tool and once deformed remain in the deformed condition.

To fasten rolled paper members in a stack of paper I have found that in most instances a conical pointed tool can flare the end of the shank to a sufficiently large diameter to prevent the paper sheets from sliding off the shank. If preferred, a more permanent binding can be obtained by fastening a paper washer on each end of the shank.

Figure 6:
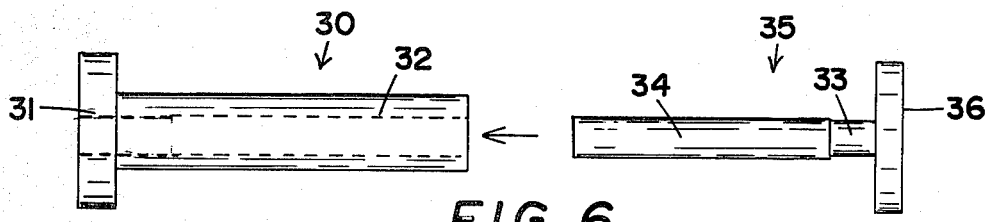
FIG. 6 shows a two-part fastening member fastening a stack of papers together.

FIG. 6 shows a two-part alternate embodiment fastener designated by reference numerals 30 and 35. Reference number 30 designates the female shank having a head 31 and a cylindrical recess 32. Reference numeral 35 denotes the male fastener having a shank 33 covered with a coating of adhesive 34.

Figure 7:
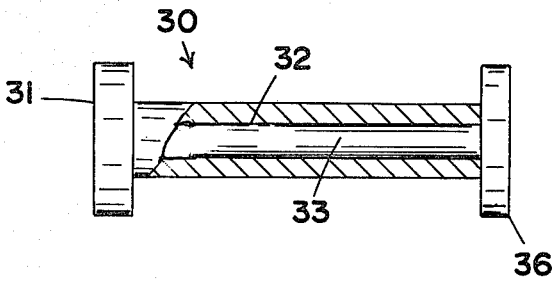
FIG. 7 shows the assembled two-part fastening member of FIG. 6.

FIG. 7 shows the two members 30 and 35 assembled with an adhesive holding the two members together. In this embodiment the adhesive may be a heat-sensitive adhesive which melts due to the friction of assembly. As an alternative embodiment, an adhesive in a rupturable capsule form or other self-sticking adhesive can also be used.

While paper is described as the preferred material for my fastener, it should be understood that other materials which can be recycled in the same process as the paper are also suitable with my invention. It is understood that my invention increases the energy efficiency of recycling of bound paper products.

I claim:

1. An apparatus for securing together the sheets of a stack of recyclable paper material having openings located therein comprising:

a fastener member rolled into a rigid cylindrical member having a shank with sufficient length to extend through an opening in a stack of sheets of recyclable paper material;

retaining means including a collar located on each end of said fastening member to prevent the sheets of the stack of recyclable paper material from slipping off said fastening member; and said fastening member constructed of a recyclable paper material so that when said sheets of recyclable paper material are recycled said fastening member can be recycled in the same process without forming harmful residue that may damage the recycling apparatus or the recycled products.

2. The invention of claim 1 wherein said fastening member is sufficiently deformable so the ends of said fastening member can be splayed outward to form retaining members to hold the stack of sheets in position.

3. The invention of claim 1 wherein said fastening member has at least one pointed end for ease of insertion of said fastening member into a stack of sheets having a set of openings therein.

4. The invention of claim 3 wherein said fastening member includes an integral head located on one end of said fastening member.

5. The invention of claim 1 wherein said fastening member is comprised of a first part and a second part with one part having an adhesive thereon for bonding said first part of said fastening member to said second part of said fastening member.

6. The invention of claim 1 wherein said fastening member is biodegradable.

7. The method of securing together a stack of papers having a set of openings with a fastener member therein for recyclable use and then after use recycling the stack of papers and the fastener member comprising the steps of:

a. inserting a fastening member of recyclable paper material through the openings in a stack of papers;

b. forming a head on the fastening member of recyclable paper material to prevent the stack of papers from slipping off the fastening member of recyclable paper material; and c. after use of the recyclable stack of papers simultaneously recycling the stack of papers with the fastening member of recyclable paper material located therein.

8. The method of claim 7 including the step of bonding the fastening member to itself to thereby hold the stack of paper in position.

* * * * *